US007313835B1

(12) United States Patent
Hodges

(10) Patent No.: US 7,313,835 B1
(45) Date of Patent: Jan. 1, 2008

(54) PORT-A-COT

(76) Inventor: Elizabeth Hodges, 8534 S. Kingston, Chicago, IL (US) 60617

( * ) Notice: Subject to any disclaimer, the term of this patent is extended or adjusted under 35 U.S.C. 154(b) by 543 days.

(21) Appl. No.: 11/016,125

(22) Filed: Dec. 18, 2004

Related U.S. Application Data

(60) Provisional application No. 60/530,437, filed on Dec. 18, 2003.

(51) Int. Cl.
*A47C 17/64* (2006.01)

(52) U.S. Cl. ..... 5/111; 5/187.1

(58) Field of Classification Search ..... 5/110–112, 5/186.1, 187, 200.1, 285
See application file for complete search history.

(56) References Cited

U.S. PATENT DOCUMENTS

| | | | | | |
|---|---|---|---|---|---|
| 1,982,165 | A | * | 11/1934 | Hounsfield | 5/114 |
| 2,670,478 | A | * | 3/1954 | Gilfillan | 5/114 |
| 3,134,987 | A | * | 6/1964 | Bertram | 5/111 |
| 3,620,428 | A | * | 11/1971 | Silverthorne | 224/156 |
| 3,956,781 | A | | 5/1976 | Reemelin | |
| 4,219,896 | A | * | 9/1980 | Behel | 5/114 |
| 4,688,281 | A | * | 8/1987 | Lantz | 5/111 |
| D338,744 | S | | 8/1993 | Marlon | |
| D407,575 | S | | 4/1999 | Meoli, Jr. | |
| 6,701,548 | B2 | * | 3/2004 | Vigneron | 5/110 |

* cited by examiner

*Primary Examiner*—Michael Trettel

(57) ABSTRACT

A foldable and portable cot that can easily be assembled and dissembled as needed. The cot includes a sheet of fabric and a pillow. The disassembled parts of the cot, along with the sheet of fabric and the pillow, can be placed within a carry bag for easy portability if desired. The carry bag has an incorporated exterior handle and resembles a golf bag in shape and design.

5 Claims, 4 Drawing Sheets

PORT-A-COT

I. CROSS-REFERENCE TO RELATED APPLICATIONS

This application claims the benefit of U.S. Provisional Application No. 60/530,437, filed Dec. 18, 2003.

II. BACKGROUND OF THE INVENTION

The present invention concerns that of a new and improved foldable and portable cot that can easily be assembled and dissembled as needed.

III. DESCRIPTION OF THE PRIOR ART

U.S. Pat. No. 3,956,781, issued to Reemelin, discloses a collapsible cot assembly comprised of a rectangular flexible sheet supported by plurality of legs.

Design Patent No. D338,744, issued to Marlon and Design Patent No. D407,575, issued to Meoli Jr., disclose ornamental designs for a portable bed assembly.

IV. SUMMARY OF THE INVENTION

The present invention concerns that of a new and improved foldable and portable cot that can easily be assembled and dissembled as needed. The cot includes a sheet of fabric and a pillow. The disassembled parts of the cot, along with the sheet of fabric and the pillow, can be placed within a carry bag for easy portability if desired. The carry bag has an incorporated exterior handle and resembles a golf bag in shape and design.

There has thus been outlined, rather broadly, the more important features of a portable cot that the detailed description thereof that follows may be better understood and in order that the present contribution to the art may be better appreciated. There are, of course, additional features of the portable cot that will be described hereinafter and which will form the subject matter of the claims appended hereto.

In this respect, before explaining at least one embodiment of the portable cot in detail, it is to be understood that the portable cot is not limited in its application to the details of construction and to the arrangements of the components set forth in the following description or illustrated in the drawings. The portable cot is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present portable cot. It is important, therefore, that the claims be regarded as including such equivalent constructions insofar as they do not depart from the spirit and scope of the present invention.

It is therefore an object of the present invention to provide a portable cot which has all of the advantages of the prior art and none of the disadvantages.

It is another object of the present invention to provide a portable cot which may be easily and efficiently manufactured and marketed.

It is another object of the present invention to provide a portable cot which is of durable and reliable construction.

It is yet another object of the present invention to provide a portable cot which is economically affordable and available for relevant market segment of the purchasing public.

Other objects, features and advantages of the present invention will become more readily apparent from the following detailed description of the preferred embodiment when considered with the attached drawings and appended claims.

V. BRIEF DESCRIPTION OF THE DRAWINGS

VI. DESCRIPTION OF THE PREFERRED EMBODIMENT

Figure 1:
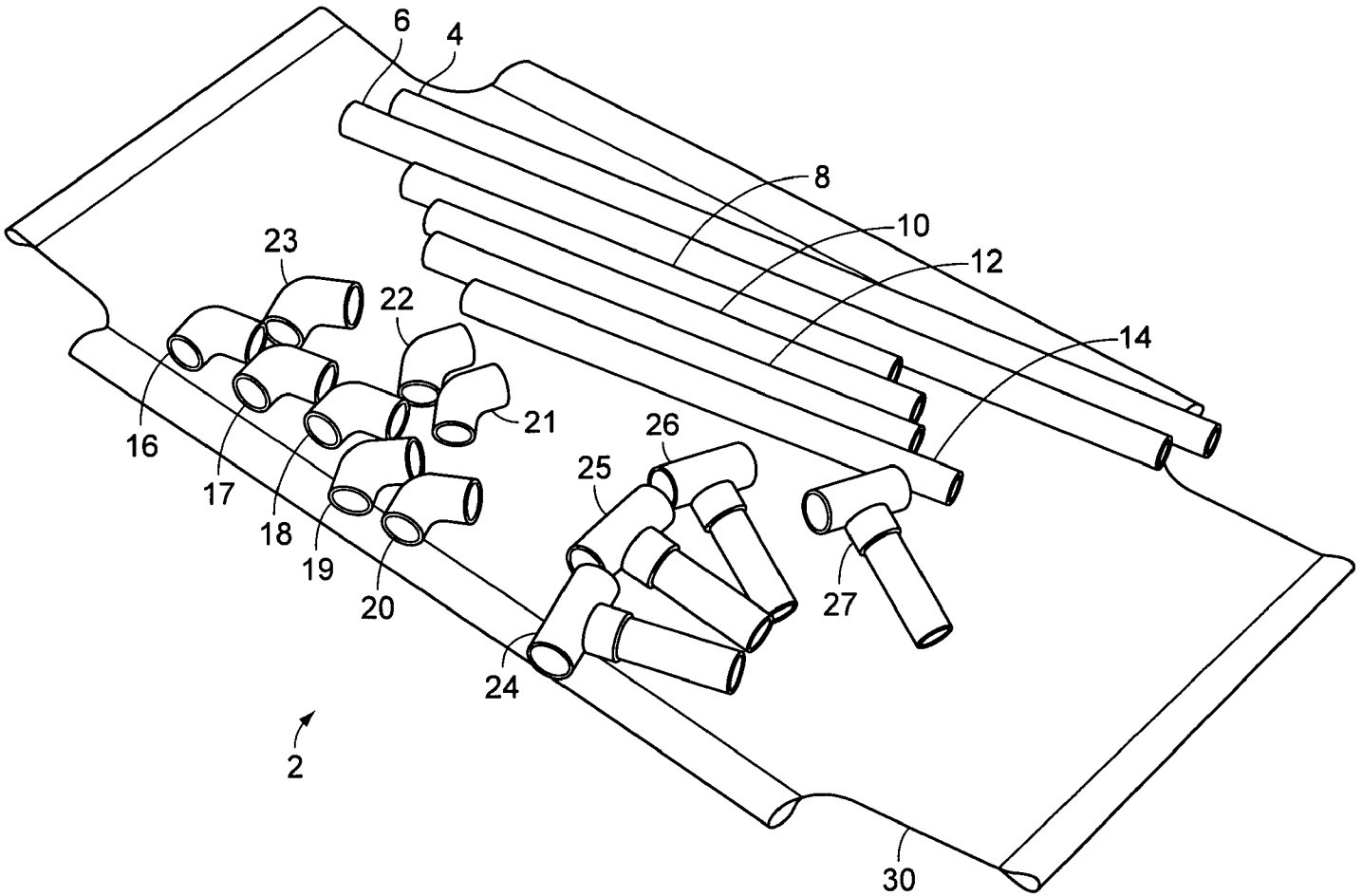
FIG. 1 shows a top perspective view of the parts of the cot as it is seen in a disassembled state.

FIG. 1 shows a top perspective view of some of the parts of the cot 2 as it is seen in a disassembled state. Cot 2 comprises left support 4, right support 6, front end 8, rear end 10, front leg 12, rear leg 14, elbows 16-23, and T-connectors 24-27.

Figure 2:
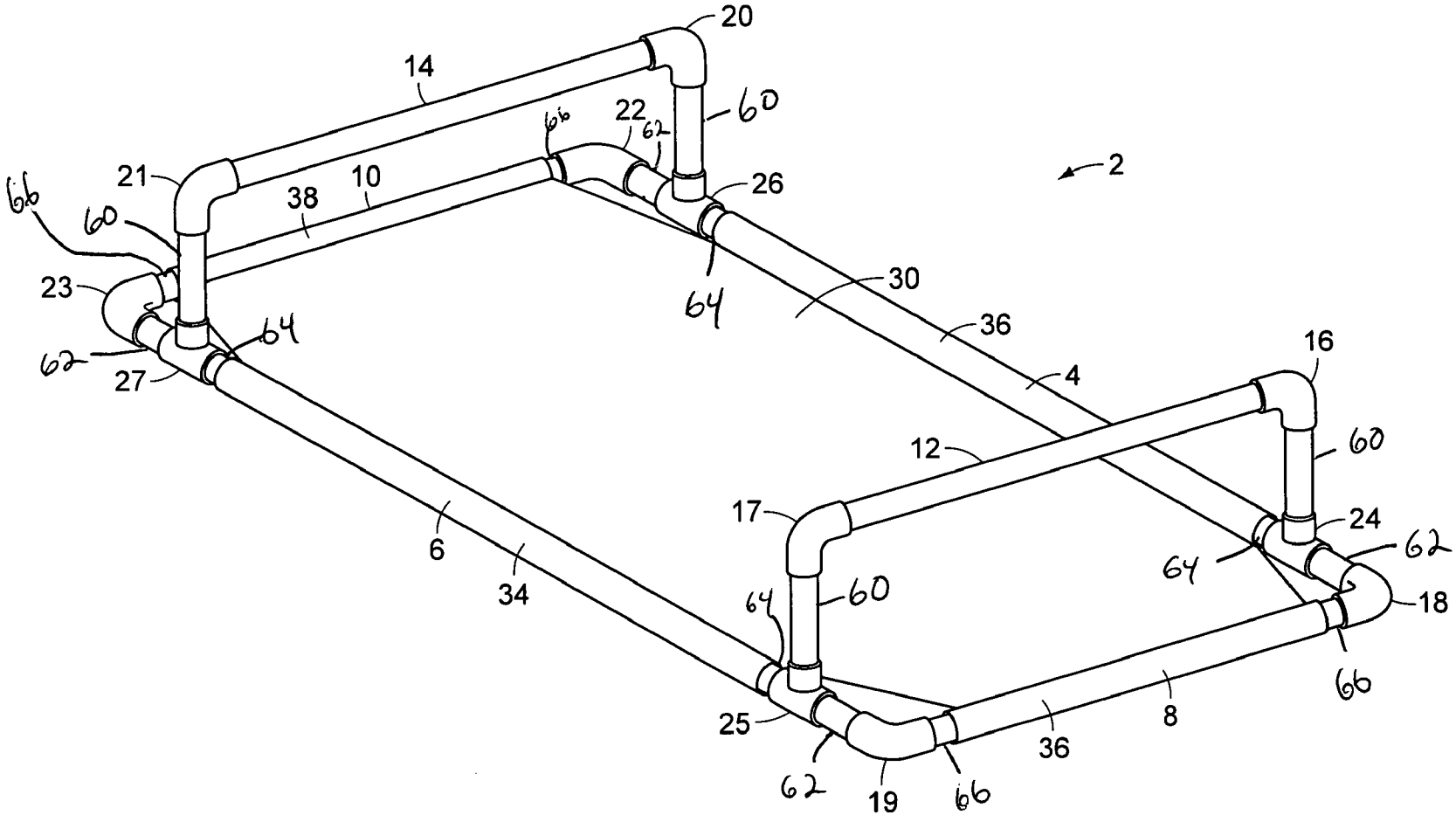
FIG. 2 shows a bottom perspective view showing the cot as it would appear with the parts assembled.
Figure 3:
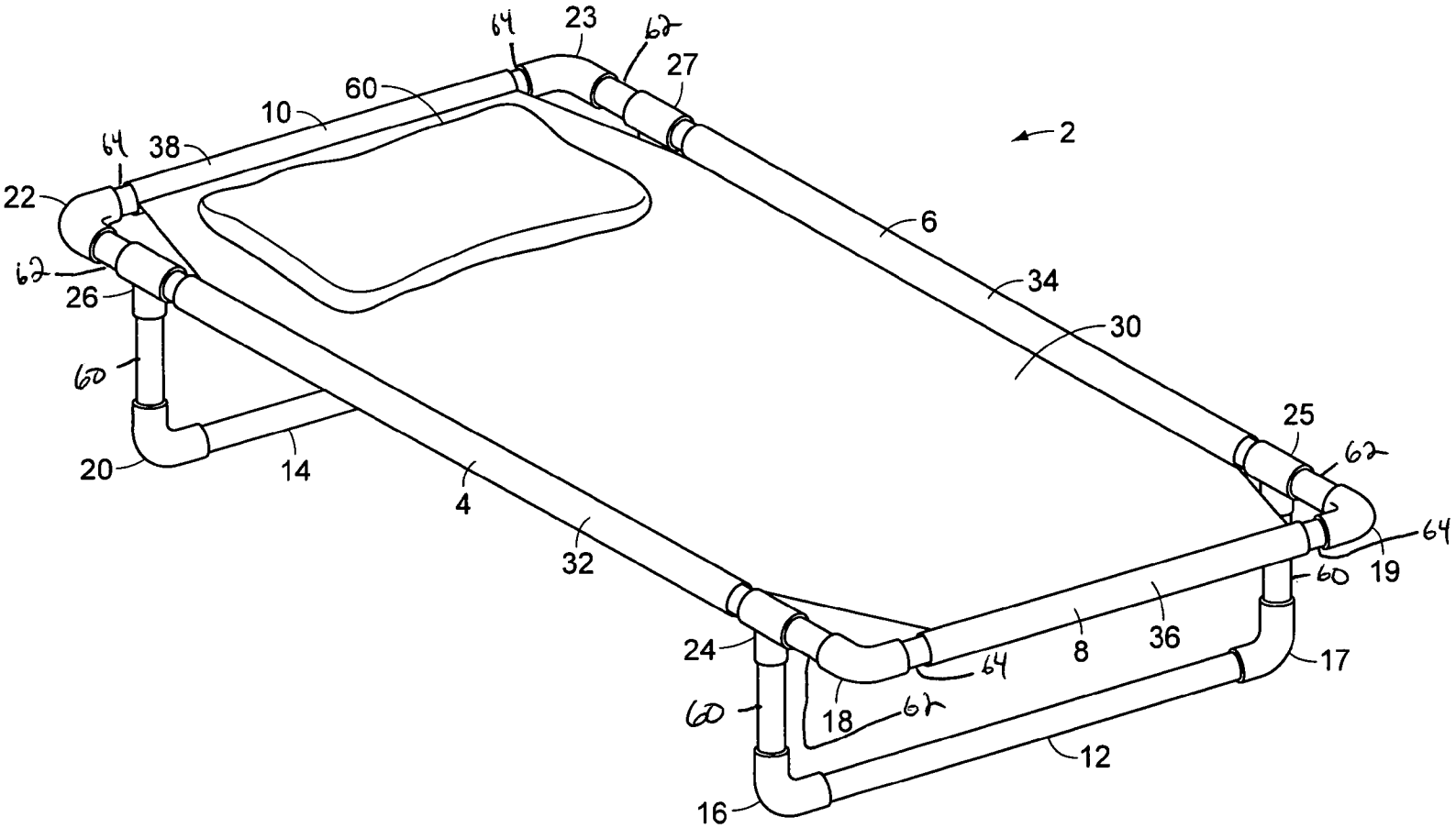
FIG. 3 shows a top perspective view showing the cot as it would appear with the parts assembled.

FIG. 2 shows a bottom perspective view showing the cot 2 as it would appear with the parts assembled, while FIG. 3 shows a top perspective view showing the cot 2 as it would appear with the parts assembled and with an included pillow 60. Left support 4 and right support 6 are the "sides" of the cot 2, with both of these parts having two ends, a first end and a second end.

The first end of left support 4 is connected to the T-connector 24 via a tube 64, while the first end of the right support 6 is connected to the T-connector 25 via a tube 64. Front leg 12 has two ends, a left end and a right end, with the left end of front leg 12 being attached to the T-connector 24 by elbow 16 and tube 60, while the right end of front leg 12 is attached to the T-connector 25 by elbow 17 by tube 60.

Elbow 18 is attached to the T-connector 24 by tube 62, while elbow 19 is attached to the T-connector 25 by tube 62. Front end 8 has two ends, a first end and a second end, with the first end of the front end 8 being connected to elbow 18 by a tube 66, while the second end of the front end 8 is connected to elbow 19 by a tube 66.

The second end of left support 4 is connected to the T-connector 26 by a tube 64, while the second end of the right support 6 is connected to the T-connector 27 by a tube 64. Rear leg 14 has two ends, a left end and a second end, with the left end of rear leg 14 being attached to the T-connector 26 by elbow 20 and a tube 60, while the right end of rear leg 14 is attached to the T-connector 27 by elbow 21 and a tube 61.

Elbow 22 is attached to the T-connector 26 by a tube 62, while elbow 23 is attached to the T-connector 27 by a tube 62. Rear end 10 has two ends, a first end and a second end, with the first end of the rear end 10 being connected to elbow 22 by a tube 66, while the second end of the rear end 10 is connected to elbow 23 by a tube 66.

As can be seen from FIGS. 2 and 3, various parts of the present invention are attached to a rectangular piece of fabric 30. Fabric 30 has two ends, a front end and a rear end, and two sides, a left side and a right side. The left side of fabric 30 has sleeve 32, while the right side of fabric 30 has sleeve 34. The front end of fabric 30 has sleeve 36, while the rear end of fabric 30 has sleeve 38. Fabric 30 itself is preferably fabricated from canvas, but can be made from other materials as well.

When left support 4 is used to assembly the cot 2, it is inserted through sleeve 32 before any other parts are attached to it. Likewise, right support 6 is inserted through sleeve 34, front end 8 is inserted through sleeve 36, and rear end 10 is inserted through sleeve 38 before any other parts are attached to them. Once the remaining parts are attached to the parts 4-10 as previously described, the fabric 30 is strong enough and taut enough to allow an individual to rest or sleep on it. Because of the four T-connectors and the front leg 12 and the rear leg 14, the fabric itself 30 will be suspended about six to eight inches above a ground surface.

Figure 4:
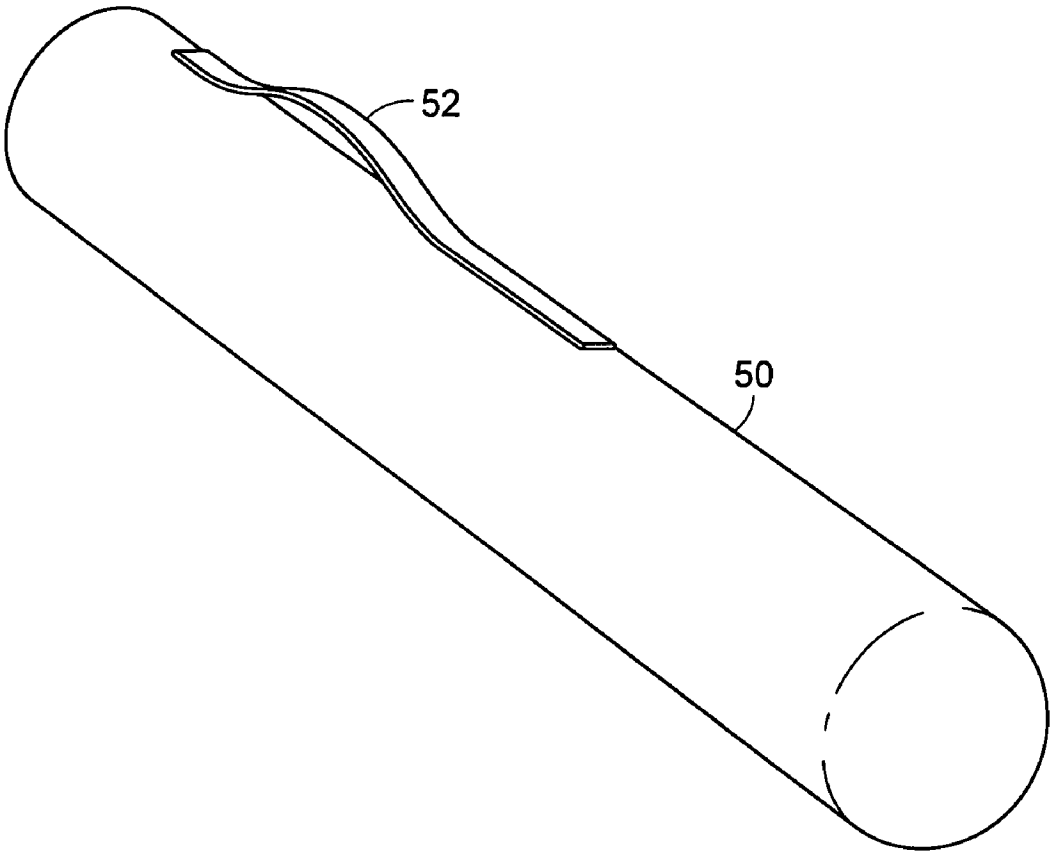
FIG. 4 shows the carry bag that accompanies the cot.

FIG. 4 shows the carry bag 50 that accompanies the cot. Pillow 60 and all the other parts would be placed within the carry bag 50 when the cot 2 would be desired to be transported to another location by an individual. Carry bag 50 has an external handle 52 to allow easy mobility of carry bag 50. Carry bag 50 looks a little like golf bag in shape and design.

What I claim as my invention is:

1. A portable cot comprising:

(a) two support rods comprising a left support rod and a right support rod, each of the two support rods having two ends, a first end and a second end, (b) a plurality of elbow connectors, wherein the first end of the left support rod is connected to a first elbow connector of the plurality of elbow connectors, further wherein the first end of the right support rod is connected to a second elbow connector of the plurality of elbow connectors, further wherein the second end of the left support rod is connected to a third elbow connector of the plurality of elbow connectors, and further wherein the second end of the right support rod is connected to a fourth elbow connector of the plurality of elbow connectors, (c) a plurality of T-connectors, the first end of the left support rod being inserted through a first T-connector of the plurality of T-connectors, the first end of the right support rod being inserted through a second T-connector of the plurality of T-connectors, the second end of the left support rod being inserted through a third T-connector of the plurality of T-connectors, the second end of the right support rod being inserted through a fourth T-connector of the plurality of T-connectors, (d) two end rods comprising a front end rod and a rear end rod, each of the two end rods having two ends, a first end and a second end, the first end of the front end rod being connected to the first end of the left support rod by a elbow connector of the plurality of elbow connectors, the second end of the front end rod being connected to the first end of the right support rod by a elbow connector of the plurality of elbow connectors, the first end of the rear end rod being connected to the second end of the left support rod by a elbow connector of the plurality of elbow connectors, and the second end of the rear end rod being connected to the second end of the right support rod by a elbow connector of the plurality of elbow connectors, (e) a front leg having two ends, a left end and a right end, the left end of the front end leg attached to the first T-connector via a fifth elbow connector of the plurality of elbow connectors, the right end of the front end leg attached to the second T-connector via a sixth elbow connector of the plurality of elbow connectors, (f) a rear leg having two ends, a left end and a right end, the left end of the rear end leg attached to the third T-connector via a seventh elbow connector of the plurality of elbow connectors, the right end of the rear end leg attached to the fourth T-connector via an eighth elbow connector of the plurality of elbow connectors, (g) a sheet of fabric having two ends, a front end and a rear end, the sheet of fabric also having two sides, a left side and a right side, and (h) means for attaching the sheet of fabric to the left support rod and a right support rod.

2. A portable cot according to claim 1 wherein the means for attaching the sheet of fabric to the left support rod and a right support rod further comprises:

(a) a left sleeve attached to the left side of the fabric, (b) a right sleeve attached to the right side of the fabric, (c) a front sleeve attached to the front end of the fabric, (d) a rear sleeve attached to the rear end of the fabric, (e) wherein the left support rod is inserted through the left sleeve of the fabric, (f) further wherein the right support rod is inserted through the right sleeve of the fabric, (g) further wherein the front end rod is inserted through the front sleeve of the fabric, and (h) further wherein the rear end rod is inserted through the rear sleeve of the fabric.

3. A portable cot according to claim 2 wherein the portable cot further comprises a pillow.

4. A portable cot according to claim 3 wherein the portable cot further comprises a carry bag, the carry bag being used to store the various components of the portable cot.

5. A portable cot according to claim 4 wherein the carry bag further comprises an external handle.

* * * * *